United States Patent [19]

Saito

[11] Patent Number: 4,958,828

[45] Date of Patent: Sep. 25, 1990

[54] SHEETS HANDLING DEVICE

[75] Inventor: Naomasa Saito, Osaka, Japan

[73] Assignee: Minolta Camera Kabushiki Kaisha, Osaka, Japan

[21] Appl. No.: 345,123

[22] Filed: Apr. 28, 1989

[30] Foreign Application Priority Data

May 1, 1988 [JP] Japan ..... 63-107917
May 1, 1988 [JP] Japan ..... 63-107918

[51] Int. Cl.[5] ..... B65H 29/00

[52] U.S. Cl. ..... 271/186; 271/184; 271/225; 271/902

[58] Field of Search ..... 271/65, 184, 185, 186, 271/225, 291, 301-305, 314, 902

[56] References Cited

U.S. PATENT DOCUMENTS 4,579,326 4/1986 Pinckney et al. ..... 271/902 X
4,780,745 10/1988 Kodama ..... 271/186 X

FOREIGN PATENT DOCUMENTS 58-113069 7/1983 Japan .
0022848 2/1984 Japan ..... 271/184
0223647 12/1984 Japan ..... 271/184
0140423 6/1986 Japan ..... 271/301
0295963 12/1986 Japan ..... 271/301
0201766 9/1987 Japan ..... 271/186
0235136 10/1987 Japan ..... 271/902
0255326 11/1987 Japan ..... 271/303
0269850 11/1987 Japan ..... 271/225
0057437 3/1988 Japan ..... 271/186
0066033 3/1988 Japan ..... 271/303
0117871 5/1988 Japan ..... 271/225
0165232 7/1988 Japan ..... 271/186
0196454 8/1988 Japan ..... 271/186

*Primary Examiner*—H. Grant Skaggs
*Assistant Examiner*—Boris Milef
*Attorney, Agent, or Firm*—Willian, Brinks, Olds, Hofer, Gilson & Lione

[57] ABSTRACT

A sheets handling device for use in association with image-forming apparatus, the device handling the sheets bearing an image fed from the image-forming apparatus such as copying apparatus and printers so as to discharge them face up or face down as desired, and also to feed them back to the image-forming apparatus for double-face or composite reproduction of image.

17 Claims, 8 Drawing Sheets

SHEETS HANDLING DEVICE

BACKGROUND OF THE INVENTION

The present invention relates to a sheets handling device for use in association with image-forming apparatus such as printers or copying apparatus, and more particularly to a device for such use to handle sheets bearing an image thereon fed from the image-forming apparatus so as to discharge them face up or face down as desired, and also to feed them back to the image-forming apparatus for double-face or composite reproduction of image. Hereinafter, the sheets bearing an image thereon will be referred to as "sheet(s)".

In general, sheets are discharged face up from image-forming apparatus such as copying apparatus or printers. Under this arrangement senior pages are consecutively placed on younger pages. After the whole pages are discharged, it is necessary to rearrange them in normal cardinal numbers. To avoid taking the toil of rearranging the pages, some copying apparatus and printers are provided with a feeder which discharges sheets face down.

Another type of image-forming apparatus are known for the provision of a feeder which feeds back sheets to the image-forming apparatus after turning them upside down so as to allow another reproduction of image on the reverse faces. Hereinafter this system will be referred to as double-face reproduction of image or merely as double-face.

A further type of image-forming apparatus include a feeder which feeds sheets back in the same posture so as to allow another reproduction of image on the same face as the previous image. Hereinafter this system will be referred to composite reproduction of image or merely composite.

However, there has been no sheets handling device of compact size which can discharge sheets either face up or face down as desired, and also feed them back to the image-forming apparatus for double-face or composite reproduction of image. In general, in order to reproduce another image on the reverse faces or on the same faces as the previous image, any device such as a box is required for storing the sheets, from which the sheets are taken out one by one. The provision of the storing device results in the increased size of the sheets handling device.

SUMMARY OF THE INVENTION

Accordingly, a principal object of the present invention is to provide a sheets handling device which can feed sheets face up or down as desired.

Another object of the present invention is to provide a sheets handling device which, as desired, can allow another reproduction of image on the reverse face or on the same face as the previous image.

A further object of the present invention is to provide a sheets handling device of such a compact size as to be detachably or permanently mountable on an image-forming apparatus.

Other objects and advantages of the present invention will become more apparent from the following detailed description, when taken in conjunction with the accompanying drawings which show, for the purpose of illustration only, embodiments in accordance with the present invention.

According to one aspect of the present invention, there is provided a sheets handling device having a receiving section for receiving a sheet from an image-forming apparatus, a discharging section for discharging the sheet out of the device, a return section for feeding back the sheet to the image-forming apparatus, a discharge path for leading the sheet from the receiving section to the discharging section, a first, a second, a third and a fourth reverse path consecutively connected to the receving section, a return path for returning the sheet from the second reverse path to the discharging section, a composite path for leading the sheet from the second reverse path to the return section, a double-face path for returning the sheet from the fourth reverse path to the return section, a first means for guiding the sheet from the receiving section to the discharge path or the first reverse path, a second means for guiding the sheet from the second reverse path to the third reverse path or the composite path, a 1st-sheet feeder capable of rotation in either direction, disposed in the second reverse path, and a 2nd-sheet feeder capable of rotation in either direction, disposed in the fourth reverse path.

According to another aspect of the present invention, there is provided a sheets handling device wherein the discharging section comprises a first sheet feeder for discharging the sheet out of the device, and the return section comprises a second sheet feeder for feeding back the sheet to the image-forming apparatus, the first sheet feeder exerting a larger feeding force on the sheet than that exerted through the normal rotation of the 1st-sheet feeder, and the second sheet feeder exerting a larger feeding force on the sheet than that exerted through the normal rotation of the 2nd-sheet feeder, and wherein the following relationships in lengths are satisfied:

$$\iota > 2\iota_1$$

$$\iota + \iota_3 > \iota_2 + \iota_1$$

$$\iota + 2\iota_3 + 2\iota_4 > \iota_0$$

$$\iota' > 2\iota'_1$$

$$\iota' + \iota'_3 > \iota'_2 + \iota'_1$$

where $\iota$: the length between the rear end of a preceding sheet and the top end of a subsequent sheet;

$\iota_1$: the length between the junction of the first reverse path, the second reverse path and the return path and the return start position in the second reverse path;

$\iota_2$: the length between the junction of the first reverse path, the second reverse path and the return path and the feeder of the discharging section;

$\iota_3$: the length between the return start position and the 1st-sheet feeder;

$\iota_4$: the length between the 1st-sheet feeder and the 2nd-sheet feeder;

$\iota'$: the length between the rear end of a preceding sheet and the top end of a subsequent sheet;

$\iota'_1$: the length between the junction of the third reverse path, the fourth reverse path and the double-face path, and the return start position in the fourth reverse path;

$\iota'_2$: the length between the junction of the third reverse path, the fourth reverse path and the double-face path, and the feeder of the return section;

$\iota'_3$: the length between the return start position in the fourth reverse path and the 2nd-sheet feeder.

$\iota_0$: the maximum length of a sheet to be handled.

DETAILED DESCRIPTION OF THE PREFERRED EMBODIMENTS

Figure 1:
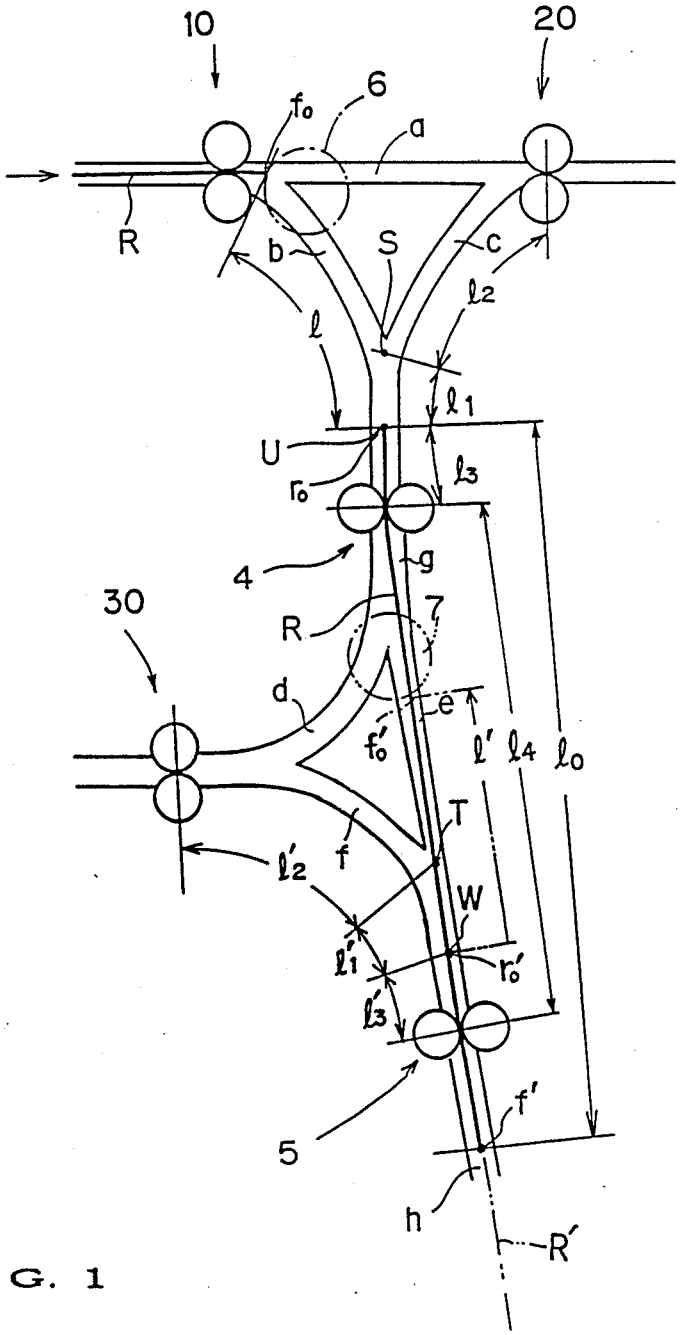
FIG. 1 is a diagrammatic view exemplifying the distances and relationships between one working section and the next.

The sheets handling device of the invention can handle sheets received from the image-forming apparatus in the face-up mode, the face-down mode, the double-face mode, or the composite mode as desired. Referring to FIG. 1, the operation in each mode will be described:

FACE-UP MODE

A sheet R fed from an image forming apparatus is received by a receiving section 10, and discharged face up along a path (a) through a discharging section 20, wherein the direction of feed is changed by a first change-over guide 6.

FACE-DOWN MODE

The sheet R received by the receiving section 10 is guided into a first reverse path (b) by the first change-over guide 6, and is advanced into a second reverse path (g), from which the sheet R is fed to a third path (e) and a fourth reverse path (h) by way of a second change-over guide 7 in accordance with the normal rotation of a 1st-sheet feeder 4. In this specification the terms "normal rotation" and "rotation" mean the rotation whereby the sheet is fed in regular course, whereas the terms "reversely rotated" and "reverse rotation" mean the rotations whereby the sheet is fed in the opposite direction.

When the rear end $r_0$ of the sheet R passes through a junction S of the first and the second reverse path and reaches a return start position U located before the 1st-sheet feeder 4, the feeder 4 is reversely rotated, thereby enabling the sheet to return the discharging section 20 by way of the return path (c). In this way the sheet R is discharged out of the device (A) face down.

DOUBLE-FACE MODE

The sheet R fed from the receiving section 10 is guided into a first reverse path (b) by the first change-over guide 6, and is advanced into a third reverse path (e) and a fourth reverse path (h) through a second change-over guide 7 in accordance with the rotation of the 1st-sheet feeder 4. A 2nd-sheet feeder 5 in the fourth reverse path (h) is rotated, thereby admitting the sheet into the path. When the rear end $r'_0$ of a preceding sheet R' passes through a junction T of the third and the fourth reverse paths, and reaches a return start position W located before the 2nd-sheet feeder 5 in the fourth reverse path, the feeder 5 is reversely rotated, thereby enabling the preceding sheet R' to return to the return section 30 by way of a double-face path (f) from which it is fed back to the image-forming apparatus. In this case, the sheet is fed in such a state as to allow either face thereof to be treated.

COMPOSITE-MODE

The sheet fed from the receiving section 10 is advanced from the first reverse path (b) to the second reverse path (g) by the first change-over guide 6. In accordance with the rotation of the 1st-sheet feeder 4 in the second reverse path (g) the sheet is further advanced to the return section 30 by way of the composite path (d) by the second change-over guide 7, from which the sheet is fed back to the image-forming apparatus.

Figure 2:
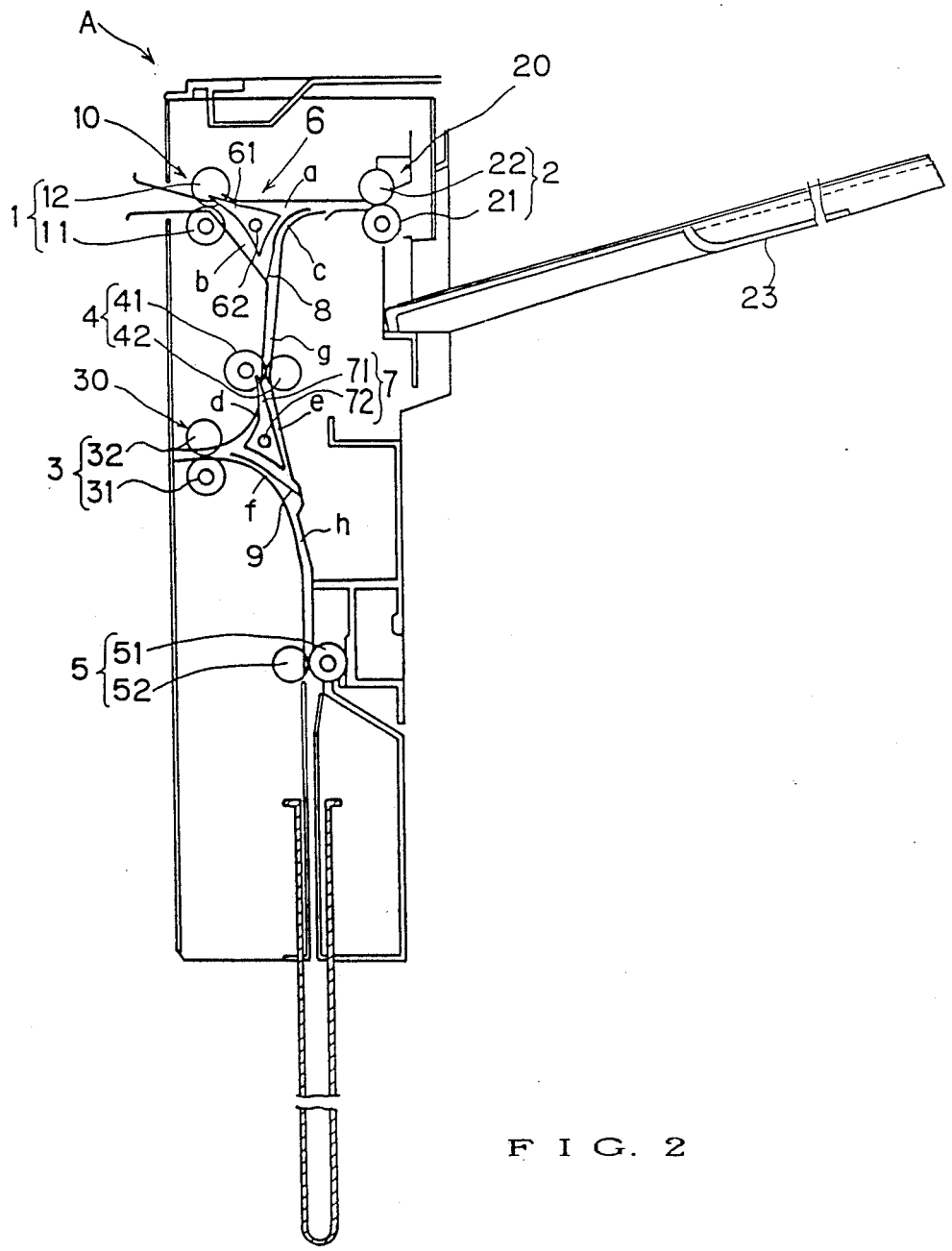
FIG. 2 is a diagrammatic side view showing a sheets handling device according to the present invention.
Figure 3:
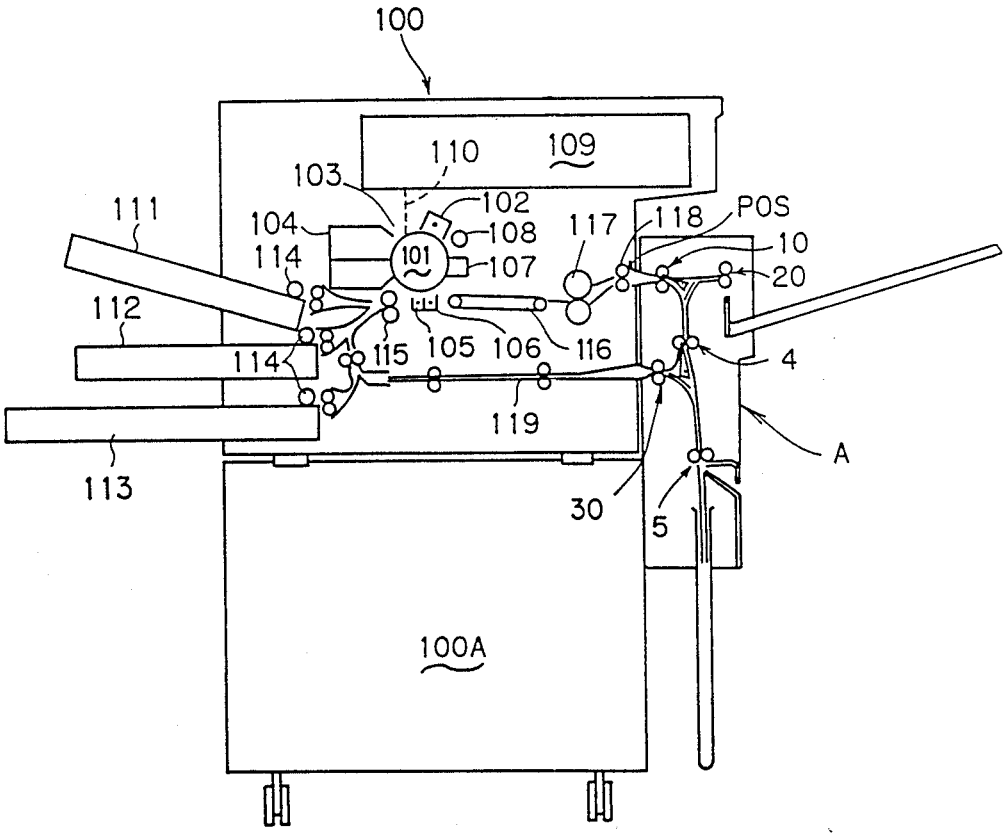
FIG. 3 is a diagrammatic side view showing the sheets handling device mounted on a laser beam printer.

Each mode has been outlined above, and referring now to the drawings it will be described in greater detail:

Referring to FIGS. 2 and 3, the sheets handling device (A) is a demountable self-contained unit; FIG. 2 shows that the device (A) is detachably attached to the outside of the printer 100. Where necessary, the device (A) can be incorporated in the image-forming apparatus as a built-in unit. The sheet receiving section 10 is located at the entrance of the device (A) such that it is faced to the discharge rollers 118 of the printer 100. The discharging section 20 is located downstream of the receiving section 10, and further downstream thereof, the return section 30 is located for communication with a return path 119 in the printer 100.

The receiving section 10 has two paths branching therefrom; one is the discharge path (a) leading to the discharging section 20, and the other is the first reverse path (b) extending downward from the receiving section 10. The path (b) is connected to the second, the third and the fourth reverse paths (g), (e) and (h), respectively, all of which paths extend downward.

The return path (c) is connected to the junction S of the paths (b) and (g). The return path (c) is designed to feed back a sheet to the discharging section 20 from the upper part of the reverse path (g).

The composite path (d) is connected to the junction of the paths (g) and (e). The composite path (d) is designed to feed back the sheet to the return section 30 from the lower end of the path (g) so as to effect the composite treatment.

The double-face path (f) is connected to the junction T of the paths (e) and (h). The double-face path (f) is designed to lead the sheet to the return section 30 from the upper end of the path (h) so as to effect the double-face treatment.

The first change-over guide 6 is designed to guide a sheet from the receiving section 10 into paths (a) or (b). The guide 6 is provided with pawls 61 secured to a shaft 62, the pawls 61 being operated by a solenoid (hereinafter referred to as SOL1) through a link mechanism (not shown). The link mechanism is constructed in the known manner; for example, it can consist of an arm secured to the shaft 62 and a rod secured to the shaft in such a manner as to be driven by SOL1. When SOL1 is off, the discharge path (a) is closed whereas the reverse path (b) is opened. When SOL1 is on, the discharge path (a) is opened whereas the path (b) is closed.

The reference numeral 8 denotes an elastic guide member (e.g. a plastic resilient sheet) disposed at an entrance of the return path (c) leading to the discharging section 20. The guide member 8 is displaced by a sheet advancing from the path (b) to the path (g), thereby permitting the sheet to pass through, but guides a sheet to the path (c) if it is likely to return from the path (g).

The second change-over guide 7 is located at a junction facing the lower end of the path (g). The guide 7 is provided with pawls 71 secured to a shaft 72, the pawls 71 being driven by a second solenoid (hereinafter referred to as SOL2) through a link mechanism (not shown) having the same structure as that described above with respect to the pawls 61. When SOL2 is off, the composite path (d) is closed whereas the third reverse path (e) is opened. When SOL2 is on, the discharge path (d) is opened whereas the path (e) is closed.

The reference numeral 9 denotes an elastic guide member (e.g. a plastic resilient sheet) disposed at a junction of the double-face path (f) and the fourth reverse path (h). The guide member 9 is displaced by a sheet advancing from the path (e) to the path (h), thereby permitting the sheet to pass through but guides a sheet to the path (f) if it is likely to return from the path (h).

The receiving section 10 includes a sheet feeder 1 which comprises a plurality of driving rollers 11 arranged at intervals in parallel with the shaft 62, and free rollers 12 in contact therewith. The discharging section 20 includes a sheet feeder 2 which comprises driving rollers 21 and free rollers 22 in contact therewith. The return section 30 includes a sheet feeder 3 which comprises a plurality of driving rollers 31 arranged at intervals in parallel with the shaft 72, and free rollers 32 in contact therewith.

The second reverse path (g) includes the 1st-sheet feeder 4 which comprises a plurality of driving rollers 41 arranged at intervals and free rollers 42 in contact therewith. The driving rollers 41 can rotate in the normal and the reverse direction. The fourth reverse path (h) is provided with a 2nd-sheet feeder 5 which comprises a plurality of driving rollers 51 and free rollers 52 in contact therewith. The driving rollers 51 can rotate in the normal and the reverse direction.

The driving rollers 41 of the feeder 4 are disposed toward the printer in the reverse path (g). The driving rollers 51 of the feeder 5 are disposed at an opposite position to the printer 100 in the path (h).

It is predetermined that the rollers 21 of the feeder 2 exerts a greater discharge force than the feeding force exerted by the rollers 41 of the feeder 4. Likewise, it is predetermined that the rollers 31 of the feeder 3 exert a greater returning force than the feeding force exerted by the rollers 51 of the feeder 5. It is arranged that the sheet is fed at a constant speed V by each feeder.

Figure 6:
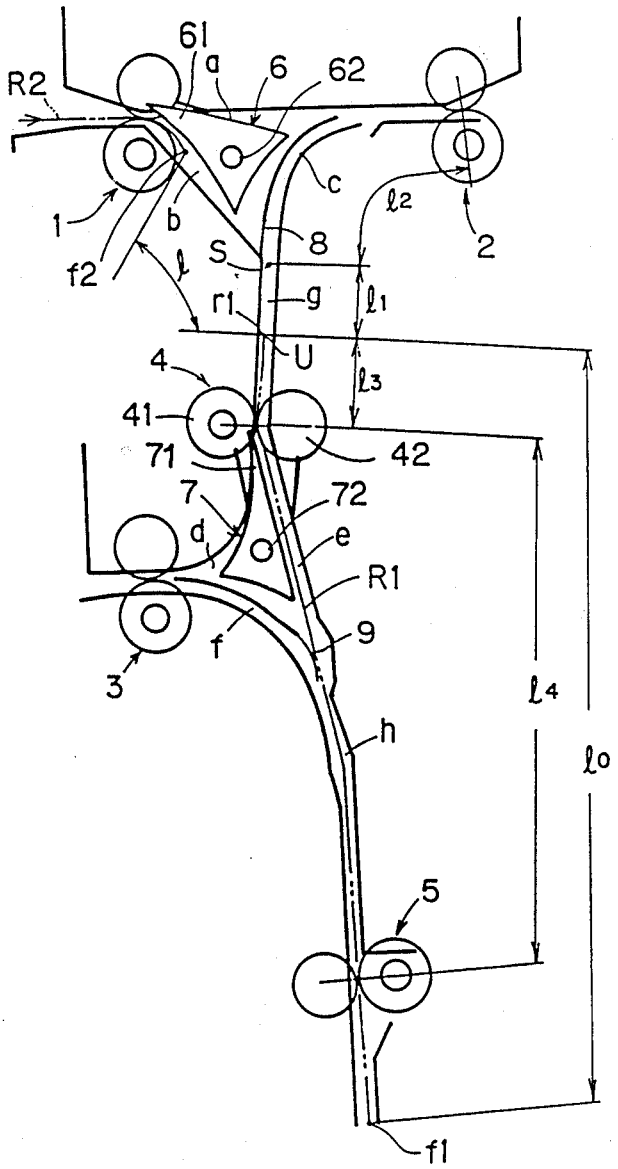
FIG. 6 is a diagrammatic view exemplifying the operation of the sheets handling device in the face-down mode.
Figure 7:
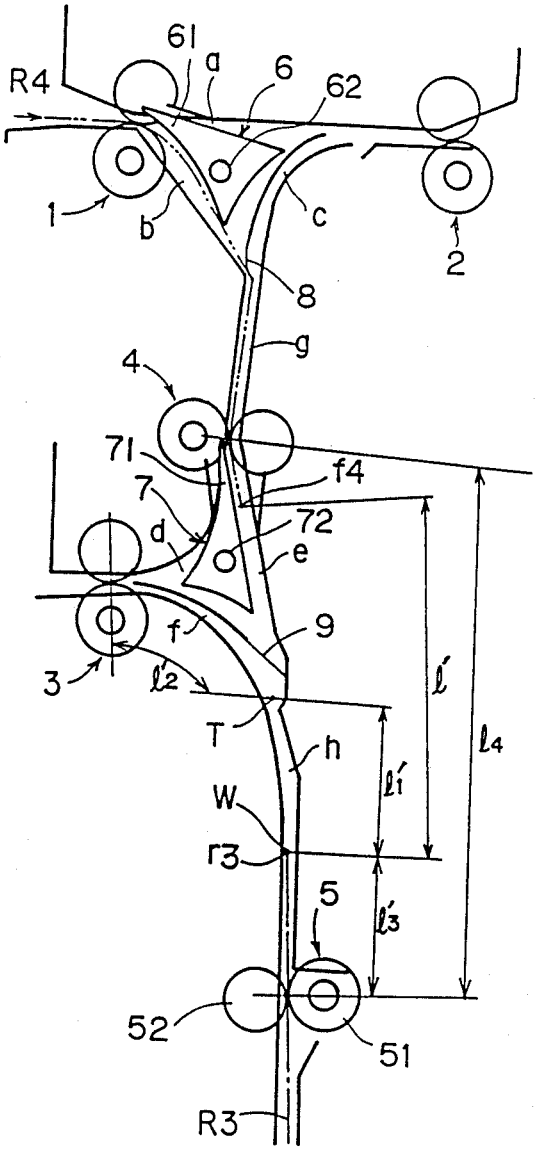
FIG. 7 is a diagrammatic view exemplifying the operation of the sheets handling device in the double-face mode.

It is arranged that the following relations in lengths are established among the sections 10, 20 and 30:

Referring to FIGS. 1 and 6, (1) $\iota$: between the rear end $r_1$ of a preceding sheet $R_1$ placed in the path (g) fed from the printer 100 and the top end $f_2$ of a subsequent sheet $R_2$ (in FIG. 1, between the rear end $r_0$ of the preceding sheet R and the top end $f_0$ of the subsequent sheet R);

(2) $\iota_1$: between the junction S of the paths (b), (g) and (c) and the return start position U in the path (g);

(3) $\iota_2$: between the junction S and the nip between the rollers of the discharging section 20;

(4) $\iota_3$: between the position U and the nip between the rollers of the feeder 4;

Referring to FIGS. 7 and 1, (5) $\iota'$: between the rear end $r_3$ of a preceding sheet $R_3$ and the top end $f_4$ of a subsequent sheet $R_4$ (in FIG. 1, between the rear end $r'_0$ of the preceding sheet and the top end $f'_0$ of the subsequent sheet);

(6) $\iota'_1$: between the junction T of the paths (e), (h) and (f) and the return start position W in the path (h);

(7) $\iota'_2$: between the junction T and the nip between the rollers of the feeder 3;

(8) $\iota'_3$: between the position W and the nip between the rollers of the 2nd-sheet feeder 5;

(9) $\iota_4$: between the nip between the rollers 41 and 42 of the feeder 4 and the nip between the rollers 51 and 52 of the feeder 5;

(10) Suppose that the maximum length of a sheet to be handled is $\iota_0$, the lengths are predetermined to satisfy the following relationships:

$$\iota > 2\iota_1$$

$$\iota + \iota_3 > \iota_2 + \iota_1$$

$$\iota + 2\iota_3 + 2\iota_4 > \iota_0$$

$$\iota' > 2\iota'_1$$

$$\iota' + \iota'_3 > \iota'_2 + \iota'_1$$

The reason for predetermining in this way will be hereinafter explained.

It is arranged that the distances in the direction of feed between one sheet feeder and the next are shorter than the shortest length of the sheets to be handled by the device (A).

As described above, the sheets handling device (A) is a demountable self-contained unit, and FIG. 3 shows that the device (A) is detachably attached to the outside of the printer 100. However, it is possible to incorporate the device A in a copying apparatus and/or a printer as a built-in unit.

As shown in FIG. 3, the laser beam printer 100 is placed on a wheeled base 100A.

The printer 100 includes a photosensitive drum 101 in the center, around which are disposed a charger 102, an exposing section 103, developing units 104, a transfer charger 105, a sheet separating charger 106, a cleaner 107 and an eraser 108. The exposing section 103 scans the photosensitive drum 101 by a beam of light 110 in response to an image signal from a laser optical system 109.

A paper is taken out of an upper cassette 111, a middle cassette 112 or a lower cassette 113 by feed rollers 114, and is fed into an image transfer section synchronously with the toner image on the drum 101 by timing rollers 115.

The image transfer section enables the toner image on the drum 101 to transfer onto the paper by the transfer charger 105. Then the paper is released from the drum 101 by the separating charger 106, and fed to a fixing unit 117 where the toner image is fixed. In this way a sheet bearing an image thereon is obtained. Finally the sheet is discharged out of the apparatus by the discharge rollers 118.

The printer 100 is provided with a return path 119 through which the sheet is fed back to the image transfer section for double-face or composite reproduction of image. The feeding-back of the copy sheet is effected by the timing rollers 115.

As described above, the sheet fed by the discharge rollers 118 is received by the receiving section 10 of the sheet handling device (A).

Figure 4:
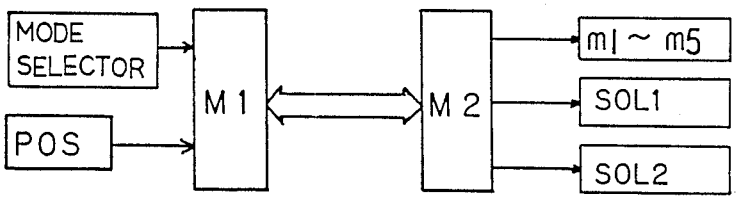
FIG. 4 is a block diagram showing a control circuit incorporated in the sheets handling device.

Referring to FIG. 4, a control circuit of the device (A) will be described:

There are provided a microcomputer M1 which controls the operation of the printer 100, and a microcomputer M2 which controls the operation of the sheet handling device (A), wherein the two microcomputers are connected with each other.

The microcomputer M1 is connected to a sensor POS for detecting the top end of a sheet, the sensor POS being disposed downstream of the discharge feed rollers 118, and a mode selector for selecting the face-up mode, the face-down mode, the double-face mode and the composite mode, the selector being disposed on an operating board of the printer 100. The sensor POS can be disposed upstream of the receiving section 10 of the device (A). Instead of the sensor POS, a suitable means can be used which generates a signal to the device (A) informing that a sheet is travelling and entering the receiving section 10.

The microcomputer M2 is connected to driving circuits of pulse motors $m_1$, $m_2$, $m_3$, $m_4$ and $m_5$ at its output, and also connected to driving circuits of the solenoids SOL1 and SOL2. These motors $M_1$ to $M_5$ drive the driving rollers of the sheet feeders 1 to 5, respectively.

The sheet handling device (A) is operated in either of the face-up mode, the face-down mode, the composite mode and the double-face mode under the control of these circuits. The operations of the sheet feeders in each mode and the solenoids in each change-over section are shown in the following table:

| Mode | Face-Up | Face-Down | Composite | Double-Face |
|---|---|---|---|---|
| Feeder 1 | normal | normal | normal | normal |
| Feeder 2 | normal | normal | stop | stop |
| Feeder 3 | stop | stop | normal | normal |
| Feeder 4 | stop | normal/reverse | normal | normal |
| Feeder 5 | stop | normal/reverse | stop | normal/reverse |
| SOL 1 | on | off | off | off |
| SOL 2 | off | off | on | off |

The operations of the feeders 4 and 5 and the on/off timing of the solenoids are shown in FIGS. 9 to 12 as a timing chart.

FACE-UP MODE

Figure 5:
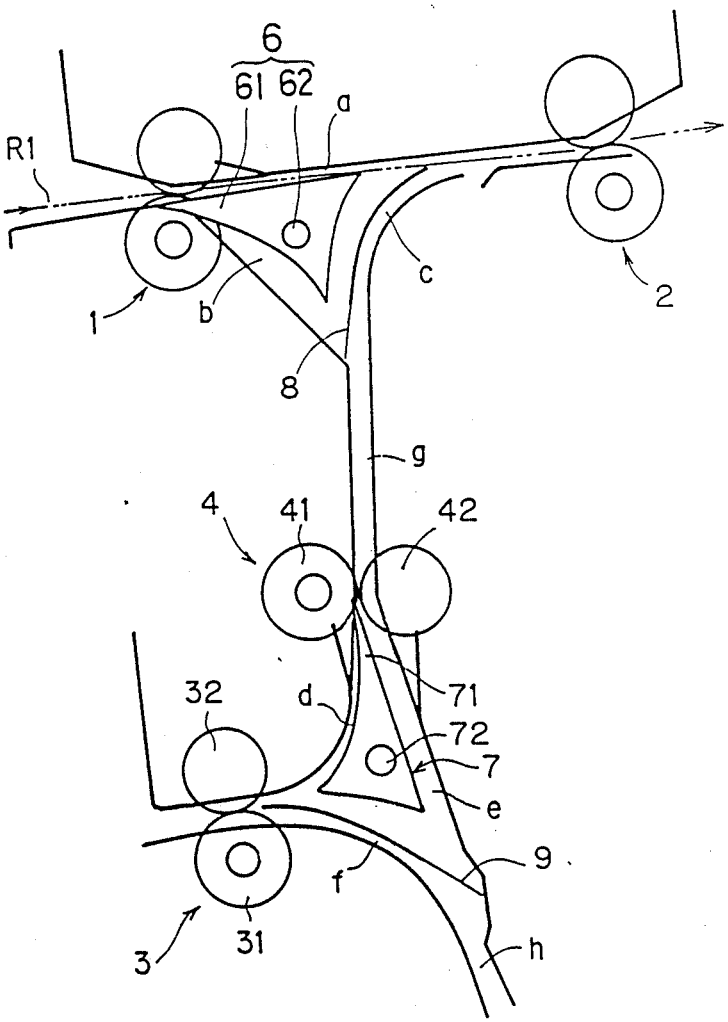
FIG. 5 is a diagrammatic view exemplifying the operation of the sheets handling device in the face-up mode.
Figure 9:
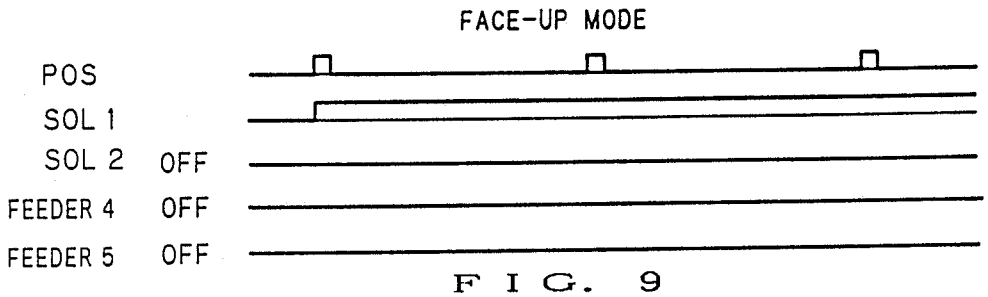
FIGS. 9 to 12 are timing charts showing the operations of the sheets handling device and the solenoids for driving the guides in the face-up mode, the face-down mode, the double-face mode and the composite mode, respectively.

Referring to FIGS. 5 and 9, the sheet $R_1$ bearing an image thereon is discharged by the rollers 118 from the printer 100 in a face-up posture, that is, with the image being up. In response to the detection of the top end of the sheet $R_1$ by the sensor POS, the feeders 1 and 2 are rotated in normal direction, and the solenoid SOL1 is on in the change-over guide 6, thereby opening the discharge path (a). In this way the sheet $R_1$ is led from the receiving section 10 to the discharging section 20 by way of the discharge path (a), from which the sheet $R_1$ is discharged face up onto a tray 23.

FACE-DOWN MODE

Figure 10:
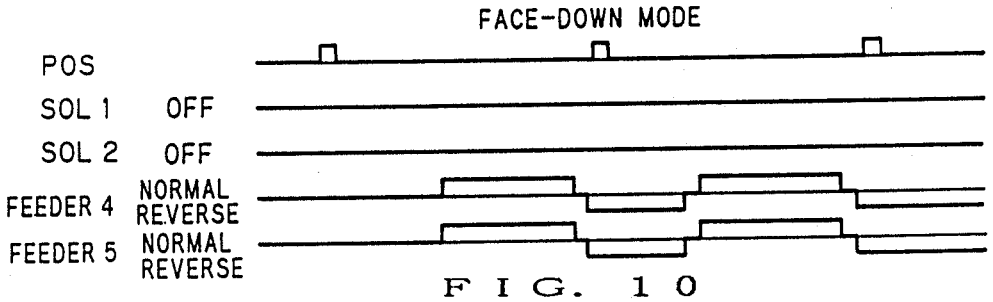

Referring to FIGS. 6 and 10, the sheet $R_1$ bearing an image thereon is discharged by the rollers 118 from the printer 100 in its face-up posture, that is, with the image being up. After the top end ($f_1$) of the sheet $R_1$ is detected by the sensor POS, the feeders 1, 4 and 5 are rotated in a normal direction, thereby enabling the sheet $R_1$ to advance to the path (h) by way of the paths (b), (g) and (e), respectively. When the rear end ($r_1$) of the sheet $R_1$ reaches the return start position U in the path (g), the feeders 4 and 5 are reversely rotated, thereby enabling the sheet $R_1$ to return to the discharging section 20 by way of the path (c). The feeder 2 thereof discharges the sheet $R_1$ onto the tray 23 in its face-down posture, that is, with the image being down.

If there is another sheet $R_2$ advancing from the printer 100 subsequently to the sheet $R_1$ when the rear end $r_1$ thereof starts to pass through the feeder 2, the feeders 4 and 5 are again rotated in the normal direction. While these two sheets pass between the driving rollers 41 and the free rollers 42 of the feeder 4 they momentarily overlap each other. However, there is no problem in discharging the sheet $R_1$ by the feeder 2 because the feeder 2 exerts a larger discharging force to the sheet $R_1$ than the feeding force the rollers 41 exerts on the sheet $R_2$, and because the rollers 41 are in frictional contact with the sheet $R_2$. In this way each sheet $R_1$ and $R_2$ is smoothly advanced in the respective direction.

The period of time from the initiation of the return of the sheet $R_1$ until the arrival of the rear end $r_1$ thereof at the position S is represented by $\iota_1/V$, where the V is the speed of feed, and the period of time from the initiation of the return of the sheet $R_1$ until the arrival of the top end $f_2$ of the subsequent sheet $R_2$ at the position S is represented by $(\iota-\iota_1)/V$. In this embodiment it is predetermined that $(\iota-\iota_1)/V$ is larger than $\iota_1/V$; that is, $\iota>2\iota_1$. Therefore, it is unlikely that the rear ends $r_1$ of the sheets $R_1$ and the top end $f_2$ of the sheet $R_2$ collide with each other.

The period of time from the initiation of the return of the sheet $R_1$ until the start of the rear end $r_1$ thereof passing through the feeder 2 is $(\iota_2+\iota_1)/V$, and the period of time from the initiation of the return of the sheet $R_1$ until the arrival of the top end $f_2$ of the subsequent sheet at the feeder 4 is $(\iota+\iota_3)/V$. In this embodiment it is predetermined that $\{(\iota+\iota_3)/V\}$ is larger than $\{(\iota_2+\iota_1)/V\}$; that is, $\iota+\iota_3>\iota_2+\iota_1$. As a result, after the rear end $r_1$ of the sheet $R_1$ has started to pass through the feeder 2, the driving rollers 41 of the feeder 4 are reversely rotated. Thus the preceding sheet $R_1$ is smoothly discharged.

The period of time from the initiation of the return of the sheet $R_1$ until the complete passage of the top end $f_1$ thereof through the feeder 5 is represented by $(\iota_0-\iota_3-\iota_4)/V$, and the period of time from the initiation of the return of the sheet $R_1$ until the arrival of the top end $f_2$ of the subsequent sheet at the feeder 5 is $(\iota+\iota_3+\iota_4)/V$. In this embodiment it is predetermined that $\{(\iota+\iota_3+\iota_4)/V\}$ is larger than $\{(\iota_0-\iota_3-\iota_4)/V\}$; that is, $\iota+2\iota_3+2\iota_4>\iota_0$. As a result, after the top end $f_1$ of the preceding sheet has passed through the feeder 5, the subsequent sheet $R_2$ is subjected to the rotation of the feeder 5 in the normal direction. Thus the preceding sheet $R_1$ is prevented from being pulled backward by the feeders 4 and 5 both in the respective normal directions.

DOUBLE-FACE MODE

Figure 11:
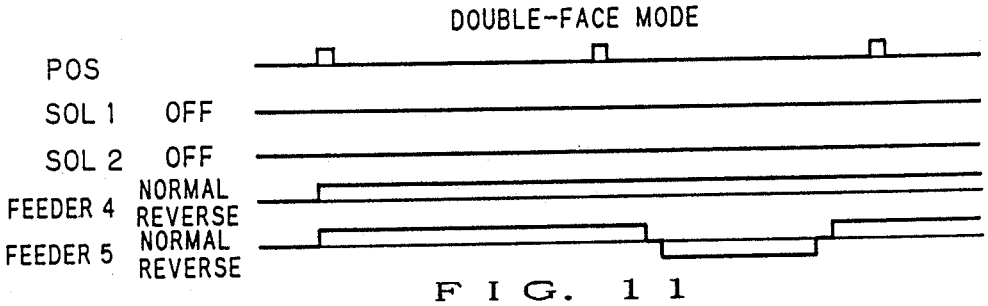

Referring to FIGS. 7 and 11, the sheet $R_3$ bearing a copy image thereon is discharged by the rollers 118 from the printer 100 in its face-up posture, that is, with the image being up. After the top end ($f_3$) thereof is detected by the sensor POS, the feeders 1, 4 and 5 are rotated in a normal direction, thereby enabling the sheet $R_3$ to advance from the receiving section 10 to the path (h) by way of the paths (b), (g) and (e), respectively. When the rear end ($r_3$) of the sheet $R_3$ reaches the return start position W in the path (h), the feeder 5 is reversely rotated, thereby enabling the sheet $R_3$ to return to the return section 30 by way of the path (f), wherein the elastic member 9 serves as a guide. The feeder 3 thereof feeds the sheet $R_3$ into the return path 119 of the printer 100 with the image being up.

If there is another sheet $R_4$ advancing from the printer 100 subsequently to the sheet $R_3$ when the rear end $r_3$ thereof starts to pass through the feeder 3, the feeder 5 is again rotated in the normal direction. While these two sheets pass between the driving rollers 51 and the free rollers 52 of the feeder 5 they mementarily overlap each other. However, there is no problem in discharging the sheet $R_3$ by the feeder 3 because the feeder 3 exerts a larger returning force to the sheet $R_3$ than the feeding force the rollers 51 exerts on the sheet $R_4$, and because the rollers 51 are in frictional contact with the sheet $R_4$. In this way the sheet $R_3$ is fed back to the printer 100, and the sheet $R_4$ is pulled in by the rollers 51.

The period of time from the initiation of the return of the sheet $R_3$ toward the return section 30 until the arrival of the rear end $r_3$ thereof at the position T is represented by $\iota'_1/V$, and the period of time from the initiation of the return of the sheet $R_3$ until the arrival of the top end $f_4$ of the subsequent sheet at the position T is $(\iota'-\iota'_1)/V$. In this embodiment it is predetermined that $(\iota'-\iota'_1)/V$ is larger than $\iota'_1/V$; that is, $\iota'>2\iota'_1$. As a result, there is no likelihood of the rear end $r_3$ of the sheet $R_3$ and the top end $f_4$ of the sheet $R_4$ colliding with each other.

The period of time from the initiation of the return of the sheet $R_3$ until the initiation of the passage of the rear end $r_3$ thereof through the feeder 3 is represented by $(\iota'_2+\iota'_1)/V$, and the period of time from the initiation of the return of the sheet $R_1$ until the arrival of the top end $f_4$ of the subsequent sheet at the feeder 5 is $(\iota'+\iota'_3)/V$. In this embodiment it is predetermined that $(\iota'+\iota'_3)/V$ is larger than $(\iota'_2+\iota'_1)/V$; that is, $\iota'+\iota'_3>\iota'_2+\iota'_1$. As a result, after the rear end $r_3$ of the sheet $R_3$ has started to be subjected to the feeding force exerted by the feeder 3, the reverse rotation of the driving rollers 51 is changed to the normal direction, therby enabling the preceding sheet $R_3$ to advance to the printer 100 smoothly.

COMPOSITE MODE

Figure 8:
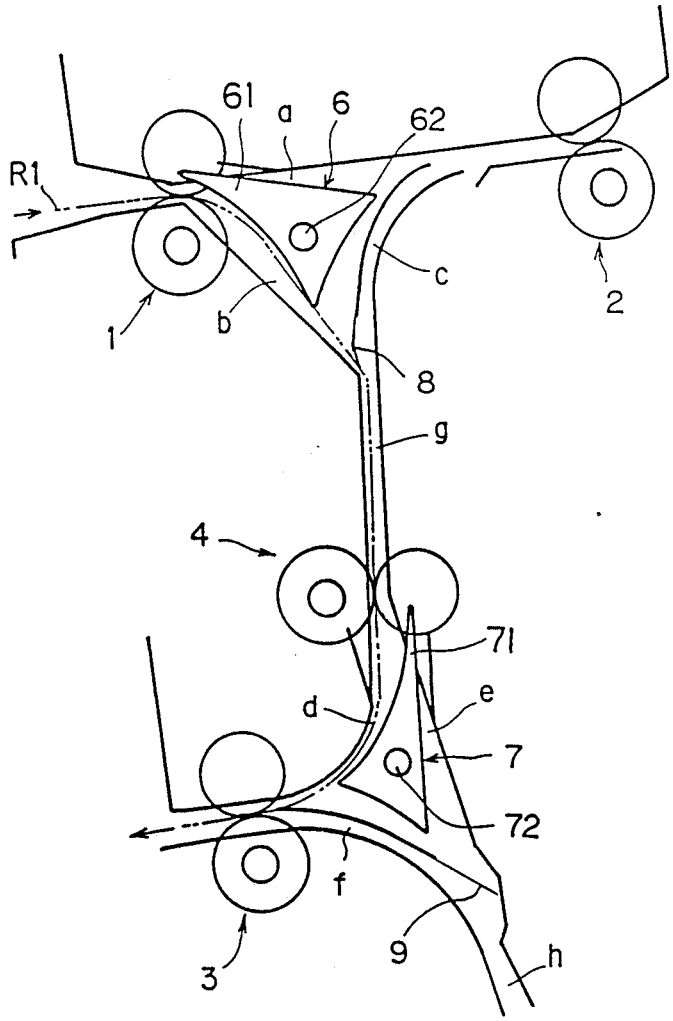
FIG. 8 is a diagrammatic view exemplifying the operation of the sheets handling device in the composite mode.
Figure 12:
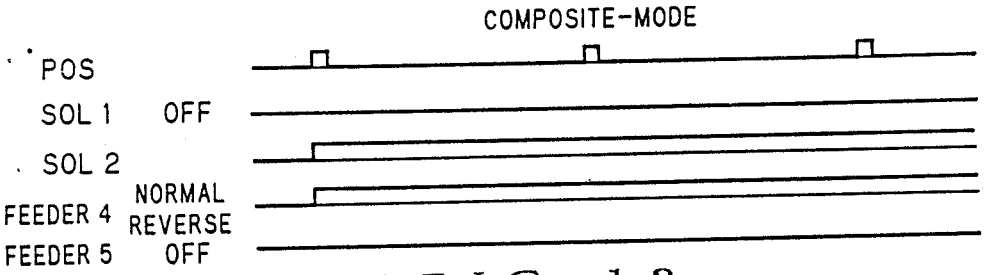

Referring to FIGS. 8 and 12, the sheet $R_1$ bearing a copy image thereon is discharged by the rollers 118 from the printer 100 in its face-up posture, that is, with the image being up. In response to the detection of the top end $f_1$ thereof by the sensor POS, the feeders 1, 4 and 3 are rotated in the normal direction, and the solenoid $SOL_2$ is on to open the composite path (d), thereby enabling the sheet to advance from the receiving section 10 to the return section 30 by way of the path (d). From there the sheet is fed to the return path 119 of the printer 100 with the image being down.

As described above, it is possible to handle sheets in any mode selected from the face-up mode, the face-down mode, the double-face mode or the composite mode.

When it is in the face-down mode and the double-face mode, a preceding sheet and a subsequent sheet are permitted to pass each other in opposite directions. This ensures that the preceding sheet is discharged out of the device or fed back to the image-forming apparatus, independently of whether it advances away from the 1st-sheet feeder 4 or the 2nd-sheet feeder 5, and also ensures that the subsequent sheet advances into the reverse path (g). This also makes it possible to minimize the distances between one section and the next, thereby speeding up the feed of the sheets.

The present invention is not limited to the embodiment described above, but various changes and modifications are of course possible without departing the spirit and scope of the invention.

As described above, it is arranged that the feeding force the discharging section 20 exerts on the sheet is larger than that the 1st-sheet feeder 4 exerts on the sheet, and that the returning force the return section 30 exerts on the sheet is larger than that the 2nd-sheet feeder 5 exerts on the sheet. However, if it is not intended that the two sheets pass each other when they pass through the 1st-sheet feeder 4 or the 2nd-sheet feeder 5, the differentiation of the forces is not necessarily required.

The interval between a preceding sheet and a subsequent sheet and the relationship between one section and the other are not necessarily limited to those mentioned above if it is not necessary to increase the sheet handling speed as the illustrated embodiment achieves. In the illustrated embodiment the sheet handling device is a demountable self-contained unit, but it is possible to incorporate the device in the image-forming apparatus.

What is claimed is:

1. A sheets handling device comprising:

a receiving section for receiving a sheet from an image-forming apparatus;

a discharging section for discharging the sheet out of the device;

a return section for feeding back the sheet to the image-forming apparatus;

a discharge path for leading the sheet from the receiving section to the discharging section;

a first, a second, a third and a fourth reverse path consecutively connected to the receiving section;

a return path for returning the sheet from the second reverse path to the discharging section;

a composite path for leading the sheet from the second reverse path to the return section;

a double-face path for returning the sheet from the fourth reverse path to the return section;

a first means for guiding the sheet from the receiving section to the discharge path or the first reverse path;

a second means for guiding the sheet from the second reverse path to the third reverse path or the composite path;

a 1st-sheet feeder capable of rotation in either direction, disposed in the second reverse path; and a 2nd-sheet feeder capable of rotation in either direction, disposed in the fourth reverse path.

2. A sheets handling device as defined in claim 1, wherein the receiving section, the discharging section and the return section respectively include a sheet feeder.

3. A sheets handling device as defined in claim 2, wherein each sheet feeder comprises a pair of driving roller and free roller.

4. A sheets handling device as defined in claim 2, wherein each sheet feeder feeds the sheet at a constant speed which is common with the other feeders.

5. A sheets handling device as defined in claim 2, wherein a distance between one feeder and the next is shorter than the shortest length, in the advancing direction, of the sheets to be handled by the device.

6. A sheets handling device as defined in claim 1, further comprising a guide member for permitting the sheet to pass from the first reverse path to the second reverse path but guiding the sheet to the return path if it is likely to return from the second reverse path, the guide member being disposed at a junction of the first reverse path, the second reverse path and the return path.

7. A sheets handling device as defined in claim 6, wherein the guide member is a resilient sheet displaceable by a sheet advancing from the first reverse path to the second reverse path, thereby permitting the sheet to pass through.

8. A sheets handling device as defined in claim 1, further comprising a guide member for permitting the sheet to pass from the third reverse path to the fourth reverse path but guiding the sheet to the double-face path if it is likely to return from the fourth reverse path, the guide member being disposed at a junction of the third reverse path, the fourth reverse path and the double-face path.

9. A sheets handling device as defined in claim 8, wherein the guide member is a resilient sheet displaceable by a sheet advancing from the third reverse path to the fourth reverse path, thereby permitting the sheet to pass through.

10. A sheets handling device as defined in claim 1, wherein each of the first and the second guiding means comprises a rotary shaft and a pawl secured to the shaft, the pawl being adapted to close one of the respective downstream-located paths and open the other in accordance with the rotation of the shaft.

11. A sheets handling device as defined in claim 1, wherein the discharging section comprises a sheet feeder for discharging the sheet out of the device, the sheet feeder exerting a larger feeding force than that exerted through the normal rotation of the 1st-sheet feeder, and wherein the following relationships in lengths are satisfied:

$$\iota > 2\iota_1$$

$$\iota + \iota_3 > \iota_2 + \iota_1$$

$$\iota + 2\iota_3 + 2\iota_4 > \iota_0$$

where $\iota$: the length between the rear end of a preceding sheet and the top end of a subsequent sheet;

$\iota_1$: the length between the junction of the first reverse path, the second reverse path and the return path and the return start position in the second reverse path;

$\iota_2$: the length between the junction of the first reverse path, the second reverse path and the return path and the feeder of the discharging section;

$\iota_3$: the length between the return start position and the 1st-sheet feeder;

$\iota_4$: the length between the 1st-sheet feeder and the 2nd-sheet feeder;

$\iota_0$: the maximum length of a sheet to be handled.

12. A sheets handling device as defined in claim 11, wherein the 1st-sheet feeder comprises a driving roller and a free roller which allow a sheet fed to the discharging section and a sheet fed from the receiving section to pass together therethrough, wherein the free roller keeps contact with the sheet fed to the discharging section whereas the driving roller keeps contact with the sheet fed from the receiving section, thereby enabling the sheets to advance in their respective directions.

13. A sheets handling device as defined in claim 1, wherein the return section comprises a sheet feeder for feeding back the sheet to the image-forming apparatus, the sheet feeder exerting a larger feeding force than that exerted through the normal rotation of the 2nd-sheet feeder, and wherein the following relationships in lengths are satisfied:

$$\iota' > 2\iota'_1$$

$$\iota' + \iota'_3 > \iota'_2 + \iota'_1$$

where $\iota'$: the length between the rear end of a preceding sheet and the top end of a subsequent sheet;

$\iota'_1$: the length between the junction of the third reverse path, the fourth reverse path and the double-face path, and the return start position in the fourth reverse path;

$\iota'_2$: the length between the junction of the third reverse path, the fourth reverse path and the double-face path, and the feeder of the return section;

$\iota'_3$: the length between the return start position in the fourth reverse path and the 2nd-sheet feeder.

14. A sheets handling device as defined in claim 13, wherein the 2nd-sheet feeder comprises a driving roller and a free roller which allow a sheet fed from the 1st-sheet feeder and a sheet fed to the return section to pass together therethrough, wherein the free roller keeps contact with the sheet to the return section and the driving roller keeps contact with the sheet from the 1st-sheet feeder.

15. A sheets handling device as defined in claim 1, wherein the sheets handling device is a self-contained unit adapted to be incorporated in image-forming apparatus as a built-in unit.

16. A sheets handling device as defined in claim 1, wherein the sheets handling device is a self-contained unit adapted to be detachably secured to image-forming apparatus.

17. A sheets handling device comprising:

a receiving section for receiving a sheet from an image-forming apparatus;

a discharging section for discharging the sheet out of the device;

a return section for feeding back the sheet to the image-forming apparatus;

a discharge path for leading the sheet from the receiving section to the discharging section;

a first, a second, a third and a fourth reverse path consecutively connected to the receiving section;

a return path for returning the sheet from the second reverse path to the discharging section;

a composite path for leading the sheet from the second reverse path to the return section;

a double-face path for returning the sheet from the fourth reverse path to the return section;

a first means for guiding the sheet from the receiving section to the discharge path or the first reverse path;

a second means for guiding the sheet from the second reverse path to the third reverse path or the composite path;

a 1st-sheet feeder capable of rotation in either direction, disposed in the second reverse path; and a 2nd-sheet feeder capable of rotation in either direction, disposed in the fourth reverse path, the discharging section comprising a first sheet feeder for discharging the sheet out of the device, and the return section comprising a second sheet feeder for feeding back the sheet to the image-forming apparatus, the first sheet feeder exerting a larger feeding force on the sheet than that exerted through the normal rotation of the 1st-sheet feeder, and the second sheet feeder exerting a larger feeding force on the sheet than that exerted through the normal rotation of the 2nd-sheet feeder, and wherein the following relationships in lengths are satisfied:

$$\iota > 2\iota_1$$

$$\iota + \iota_3 > \iota_2 + \iota_1$$

$$\iota + 2\iota_3 + 2\iota_4 > \iota_0$$

$$\iota' > 2\iota'_1$$

$$\iota' + \iota'_3 > \iota'_2 + \iota'_1$$

where $\iota$: the length between the rear end of a preceding sheet and the top end of a subsequent sheet;

$\iota_1$: the length between the junction of the first reverse path, the second reverse path and the return path and the return start position in the second reverse path;

$\iota_2$: the length between the junction of the first reverse path, the second reverse path and the return path and the feeder of the discharging section;

$\iota_3$: the length between the return start position and the 1st-sheet feeder;

$\iota_4$: the length between the 1st-sheet feeder and the 2nd-sheet feeder;

$\iota'$: the length between the rear end of a preceding sheet and the top end of a subsequent sheet;

$\iota_1'$: the length between the junction of the third reverse path, the fourth reverse path and the double-face path, and the return start position in the fourth reverse path;

$\iota_2'$: the length between the junction of the third reverse path, the fourth reverse path and the double-face path, and the feeder of the return section;

$\iota_3'$: the length between the return start position in the fourth reverse path and the 2nd-sheet feeder;

$\iota_0$: the maximum length of a sheet to be handled.

* * * * *